US007397489B2

(12) United States Patent
Mindler et al.

(10) Patent No.: US 7,397,489 B2
(45) Date of Patent: Jul. 8, 2008

(54) SYSTEM AND METHOD FOR EFFICIENT DONOR MATERIAL USE

(75) Inventors: Robert F. Mindler, Churchville, NY (US); Paul H. Forest, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 380 days.

(21) Appl. No.: 11/238,386

(22) Filed: Sep. 29, 2005

(65) Prior Publication Data

US 2006/0181598 A1 Aug. 17, 2006

Related U.S. Application Data

(63) Continuation-in-part of application No. 11/060,178, filed on Feb. 17, 2005.

(51) Int. Cl.
*B41J 2/325* (2006.01)

(52) U.S. Cl. ..... 347/176; 400/120.04

(58) Field of Classification Search ..... 347/171, 347/172, 174, 176, 217; 400/120.04
See application file for complete search history.

(56) References Cited

U.S. PATENT DOCUMENTS 5,445,463 A 8/1995 Paranjpe
5,567,066 A 10/1996 Paranjpe
5,691,961 A * 11/1997 Paranjpe ..... 347/217
5,982,405 A * 11/1999 Sasaki et al. ..... 347/176
6,121,987 A 9/2000 Sasaki et al.
7,286,152 B2 * 10/2007 Mindler et al. ..... 347/212
2006/0181596 A1 * 8/2006 Mindler et al. ..... 347/171
2006/0181597 A1 * 8/2006 Mindler ..... 347/171
2007/0024693 A1 * 2/2007 Anderson et al. ..... 347/213

FOREIGN PATENT DOCUMENTS

EP 1 462 268 A2 9/2004

* cited by examiner

*Primary Examiner*—Huan H Tran
(74) *Attorney, Agent, or Firm*—Roland R. Schindler

(57) ABSTRACT

Methods and control systems are provided for operating a thermal printer adapted to print images by heating and transferring donor material from donor patch sets from onto a receiver medium, the printer being operable to print images in a manner that exhausts a full donor patch set or a fractional donor patch set during printing. The control system comprises a controller for identifying one of the donor patch sets on the web as a fractional donor patch set having sufficient donor material remaining to print an image. The controller is further adapted to determine that the fractional donor patch set is not to be used for printing when the identified fractional donor patch set has been used to print an image wherein at least a minimum area of at least one donor patch has been heated to a level above a threshold level.

16 Claims, 4 Drawing Sheets

SYSTEM AND METHOD FOR EFFICIENT DONOR MATERIAL USE

CROSS REFERENCE TO RELATED APPLICATIONS

This is a continuation-in-part of application Ser. No. 11/060,178, filed Feb. 17, 2005, entitled SYSTEM AND METHOD FOR EFFICIENT DONOR MATERIAL USE by Robert F. Mindler.

FIELD OF THE INVENTION

The present invention relates to thermal printers that record images by transferring donor materials from a donor ribbon and methods for operating the same to improve the printing of the use of donor material.

BACKGROUND OF THE INVENTION

In thermal printing, it is generally well known to render images by heating and pressing one or more donor materials such as a dye, colorant or other coating against a receiver medium. The donor materials are provided in sized donor patches on a movable web known as a donor ribbon. The donor patches are organized on the ribbon into donor patch sets, each donor patch set contains all of the donor patches that are to be used to record an image on the receiver medium. For full color images, multiple colored dye sets can be used, such as yellow, magenta and cyan donor dye patches. Arrangements of other color patches can be used in like fashion within a donor patch set. Additionally, each donor set can include an overcoat or sealant layer.

It will be appreciated from this that the size of the donor patches defines the full size image that can be printed using a conventional thermal printer. To provide flexibility of use, many thermal printers are capable of printing relatively large images such as6"×8" images. While prints of this size are highly desirable for many uses, it can be challenging to use and store images printed at this size. Accordingly, consumers often request that such printers render images at a fraction of the full size image, such as images printed at the wallet size, 3"×5" size or 4"×6" size. Images at these sizes are more easily used and stored and exhausts only a fraction of the donor material from a donor patch set leaving a fraction donor patch set.

Unfortunately, the printers of the prior art are not adapted to use the remaining donor material from a fractionally used donor patch set for printing other images. Instead, it is conventionally known to have a thermal printer advance to the next complete donor set after printing a fractional size image so that the thermal printer is prepared to print any size image when the next printing order is received. It will be appreciated that this results in inefficient use of the donor material causing increased printing expense. What is needed therefore is a thermal printer control system and a method that enables more efficient use of donor material.

SUMMARY OF THE INVENTION

Figure 1:
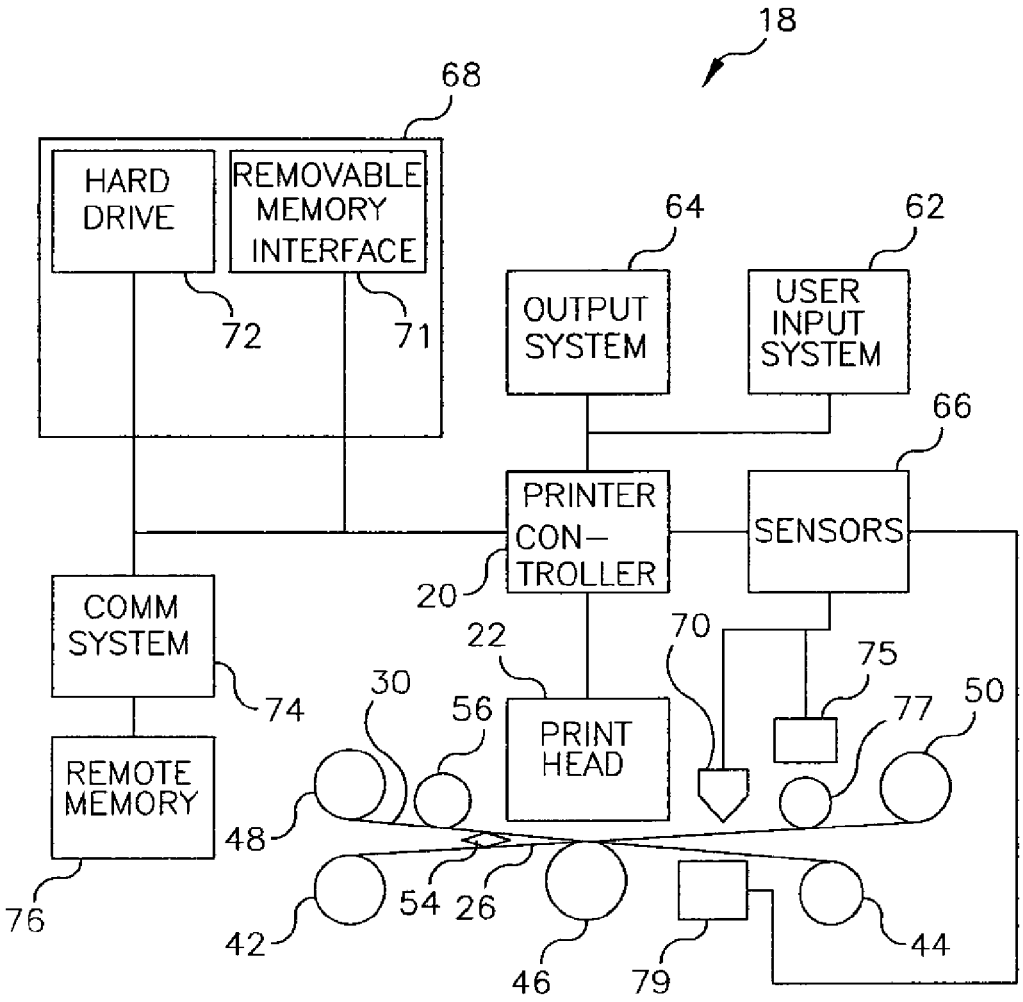
FIG. 1 shows a first embodiment of a printer.

In one aspect of the invention, a method is provided for operating a thermal printer adapted to print an image by heating donor material from one of sequence of sets of donor material patches on a donor ribbon and transferring the thermally loaded donor material to a donor ribbon, the method comprising the steps of: receiving image data for a first image to be printed; printing the first image exhausting only a fraction of a full donor patch set to leave a fractional donor patch set having sufficient donor material for the printing of a second image; and preventing the printing of a second image using the fractional donor patch set when it is determined that the printing of the first image has heated a minimum area of area of one of the donor patches of the donor ribbon above a threshold level.

In another aspect of the invention, a control system is provided for a thermal printer adapted to print images by transferring donor material from patches of donor material on a donor ribbon to form an image on a receiver medium, the printer being operable to print images in a manner that exhausts a full donor patch set or in a manner that exhausts a fractional donor patch set during printing. The control system comprises a controller adapted to receive a print order, to determine whether a fractional donor patch set is available for printing; and to cause an image to be printed using donor material from an available fractional donor patch set where at least part of the print order can be satisfied using donor material from the fractional donor patch set except where the controller determines that the available fractional donor patch set has been used to print a previous image having an average image density in a minimum portion of the image that is greater than a threshold average image density.

In yet another aspect of the invention, a control system is provided for operating a thermal printer adapted to print images by heating and transferring donor material from donor patch sets from onto a receiver medium, the printer being operable to print images in a manner that exhausts a full donor patch set or a fractional donor patch set during printing, comprising: a means for receiving a print order; and a controller for determining whether a fractional donor patch set is available that has not been used to print a previous image during which sufficient heat was applied to the donor ribbon to alter the donor ribbon in a manner that can enable modification of the donor ribbon in the event that the controller causes the donor ribbon to be repositioned for printing using the fractional donor patch set or in the event that the controller causes the fractional donor patch set to be used to print an image from the print order; wherein the controller further determines when an image from the print order can be printed using an available fractional donor patch set and causes the image from the print order to be printed using the available fractional donor patch set.

In still another aspect of the invention, a control system for operating a thermal printer adapted to print images by heating and transferring donor material from donor patch sets from onto a receiver medium, the printer being operable to print images in a manner that exhausts a full donor patch set or a fractional donor patch set during printing. The control system comprises a controller for identifying one of the donor patch sets on the web as a fractional donor patch set having sufficient donor material remaining to print an image, the controller further being adapted to determine that the fractional donor patch set is not to be used for printing when the identified fractional donor patch set has been used to print an image wherein at least a minimum area of at least one donor patch has been heated to a level above a threshold level.

DETAILED DESCRIPTION OF THE INVENTION

FIG. 1 shows a first embodiment of a printer 18 as having a printer controller 20 of the invention. Printer controller 20 causes printhead 22 to record images on a receiver medium 26 by transferring material from a donor ribbon 30 to receiver medium 26. Printer controller 20 can include but is not limited to a programmable digital computer, a programmable microprocessor, a programmable logic controller, a series of electronic circuits or a series of electronic circuits reduced to the form of an integrated circuit, or a series of discrete components. In the embodiment of FIG. 1, printer controller 20 also controls a receiver medium take-up roller 42, a receiver medium supply roller 44, a donor ribbon take-up roller 48 and a donor ribbon supply roller 50, which are each motorized for rotation on command of the printer controller 20 to effect movement of receiver medium 26 and donor ribbon 30. Printer controller 20 receives input signals from a user input system 62, an output system 64, sensors 66, a memory 68 and a communication system 74 and uses these input signals for operating printer 18.

Figure 2:
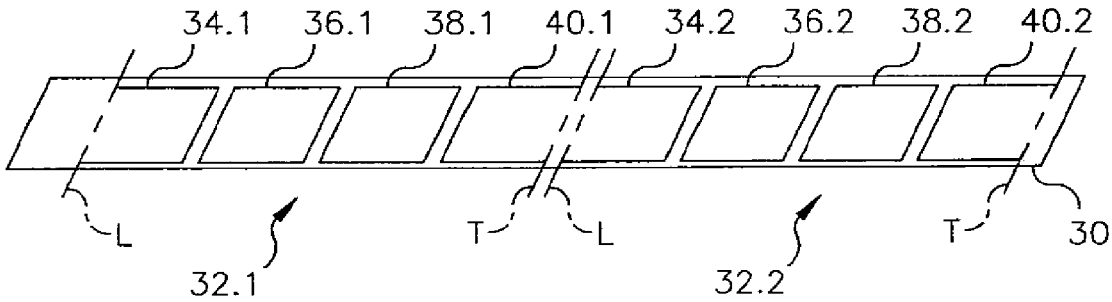
FIG. 2 shows one embodiment of a donor ribbon.

As is shown in FIG. 2, an example donor ribbon 30 comprises a first donor patch set 32.1 having a yellow donor patch 34.1, a magenta donor patch 36.1, a cyan donor patch 38.1 and a clear overcoat patch 40.1 and a second donor patch set 32.2 having a yellow donor patch 34.2, a magenta donor patch 36.2, a cyan donor patch 38.2 and a clear overcoat patch 40.2. Each donor patch set has a leading edge (L) and a trailing edge (T). In order to provide a full color image with a clear protective coating, the four patches of each set 32.1 and 32.2, etc. are printed, in registration with each other, onto a common image receiving area 52 of receiver medium 26 shown in FIG. 3.

Figure 3:
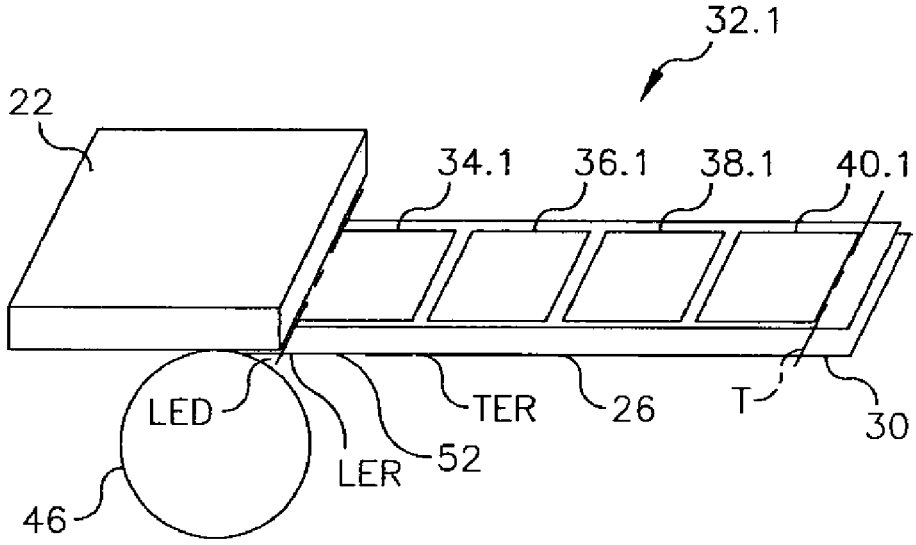
FIG. 3 shows a printhead, donor ribbon and receiver ribbon at a start of a first printing process for a first donor patch.

A first color is printed in the conventional direction, from right to left as seen by the viewer in FIG. 1 and 3. During printing, printer controller 20 raises printhead 22 and actuates donor ribbon supply roller 50 and donor ribbon take-up roller 48 to advance a leading edge L of a first donor patch set 32.1 to printhead 22. In the embodiment illustrated in FIGS. 1-3, leading edge L for first donor patch set 32.1 is defined by at a leading edge of a yellow donor patch 34.1. The position of this leading edge L can be determined by using a position sensor to detect a marking, indicia on donor ribbon 30 that has a known position relative to the leading edge of yellow donor patch 34.1 or by directly detecting leading edge of yellow donor patch 34.1 as will be discussed in greater detail below.

Printer controller 20 also actuates receiver medium take up roller 42 and receiver medium supply roller 44 so that image receiving area 52 of receiver medium 26 is positioned with respect to the printhead 22. In the embodiment illustrated, the image receiving area 52 is defined by a leading edge LER and a trailing edge TER on receiver medium 26. When donor ribbon 30 and receiver medium 26 are positioned so that leading edge LED of yellow donor patch 34.1 is registered at printhead 22 with leading edge LER of image receiving area 52. Printer controller 20 then lowers printhead 22 so that a lower surface of donor ribbon 30 engages receiver medium 26 which is supported by the platen roller 46.

Figure 4:
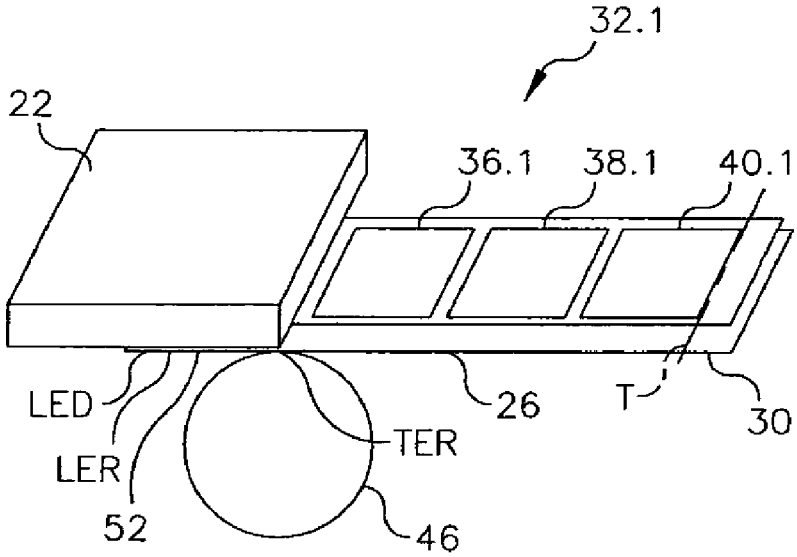
FIG. 4 shows a printhead, donor ribbon and receiver ribbon at a conclusion of a first printing process for a first donor patch.

Printer controller 20 then actuates receiver medium take-up roller 42, receiver medium supply roller 44, donor ribbon take-up roller 48 and donor ribbon supply roller 50 to move receiver medium 26 and donor ribbon 30 together past the printhead 22. Printer controller 20 selectively operates heater elements (not shown) in printhead 22 to transfer donor material yellow donor patch 34.1 to receiver medium 26. As donor ribbon 30 and receiver medium 26 leave the printhead 22, a stripping plate 54 separates donor ribbon 30 from receiver medium 26. Donor ribbon 30 continues over idler roller 56 toward the donor ribbon take-up roller 48. As shown in FIG. 4, the trailing edge TER of image receiving area 52 of receiver medium 26 remains on platen roller 46. Printer controller 20 then adjusts the position of donor ribbon 30 and receiver medium 26 using a predefined pattern of donor ribbon movement so that a leading edge of each of the remaining donor patches 36.1, 38.1 and 40.1 in the first donor patch set 32.1 are brought into alignment with leading edge LER of image receiving area 52 and the printing process is repeated to transfer further material as desired to complete image format.

Printer controller 20 operates the printer 18 based upon input signals from a user input system 62, an output system 64, sensors 66, a memory 68 and a communication system 74.

User input system 62 can comprise any form of transducer or other device capable of receiving an input from a user and converting this input into a form that can be used by printer controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by printer controller 20 to provide human perceptible signals for feedback, informational or other purposes.

Sensors 66 can include light sensors and other sensors known in the art that can be used to detect conditions in the environment-surrounding printer 18 and to convert this information into a form that can be used by printer controller 20 in governing printing operation. In the embodiment of FIG. 1, sensors 66 include a donor position sensor 70 that is adapted to detect the position of donor ribbon 30 and a receiver medium position sensor 79. Printer controller 20 cooperates with donor position sensor 70 to monitor donor ribbon 30 during movement thereof so that printer controller 20 can detect one or more conditions on donor ribbon 30 that indicate a leading edge of a donor patch set. In this regard, a donor ribbon 30 can be provided that has markings or other optically, magnetically or electronically sensible indicia between each donor frame set. Where such markings or indicia are provided, position sensor 70 is provided to sense these markings or indicia and to provide signals to printer controller 20. Printer controller 20 can use these markings and indicia to determine when donor ribbon 30 is positioned with the leading edge of the donor patch set at printhead 22. In a similar way, printer controller 20 can use signals from receiver medium position sensor 79 to monitor the position of the receiver to align receiver medium 26 during printing.

During a full image printing operation, printer controller 20 causes donor ribbon 30 to be advanced in a predetermined pattern of distances so as to cause a leading edge of each of the first donor patches 34.1, 36.1, 38.1 and 40.1 to be properly positioned relative to the image receiving area 52 at the start each printing process. Printer controller 20 can be adapted to achieve such positioning by precise control of the movement of donor ribbon 30 using a stepper type motor for motorizing donor ribbon take up roller 48 or donor ribbon supply roller 50 or by using a movement sensor 75 that can detect movement of donor ribbon 30. In one example an arrangement using a movement sensor 75, a follower wheel 77 is provided that engages donor ribbon 30 and moves therewith. Follower wheel 77 can have surface features that are optically, magnetically or electronically sensed by movement sensor 75. One example of this is a follower wheel 77 that has markings thereon indicative of an extent of movement of donor ribbon 30 and a movement sensor 75 that has a light sensor that can sense light reflected by the markings. In other embodiments, perforations, cutouts or other routine and detectable indicia can be incorporated onto donor ribbon 30 in a manner that enables a movement sensor 75 to provide an indication of the extent of movement of the donor ribbon 30.

Alternatively, position sensor 70 can be adapted to sense the color of donor patches on donor ribbon 30 and that can provide color signals to printer controller 20. In this alternative, controller 20 is programmed or otherwise adapted to detect a color that is known to be found in the first donor patch, e.g. yellow donor patch 34.1 in a donor patch set such as first donor patch set 32.1. When the first color is detected, printer controller 20 can determine that donor ribbon 30 is positioned proximate to the start of a donor patch set.

Data including but not limited to control programs, digital images and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. In the embodiment of FIG. 1, memory 68 is also shown having a hard drive 72 that is fixed with printer 18 and a remote memory 76 that is external to printer controller 20 such as a personal computer, computer network or other imaging system.

In the embodiment shown in FIGS. 1-3, printer controller 20 has a communication system 74 for communicating external devices such as remote memory 76. Communication system 74 can be for example, an optical, radio frequency circuit or other transducer that converts electronic signals representing an image and other data into a form that can be conveyed to a separate device by way of an optical signal, radio frequency signal or other form of signal. Communication system 74 can also be used to receive a digital image and other information from a host computer or network (not shown). Printer controller 20 can also receive information and instructions from signals received by communication system 74.

Printer controller 20 is operable to cause printing of at least two differently sized images. In a full image mode, printer controller 20 prints images having image sizes will exhaust most or all of the donor material in the donor patches of a donor patch set. In one example of this type, some images will be sized so that they will require donor material from an entire donor patch. Likewise other combinations of images such as a request for a set of multiple wallet-sized prints will likewise consume substantially all of the donor material available in a single donor patch set. Printer controller 20 is also adapted to print images having various sizes that exhaust only a fraction of the donor material provided by a donor patch set and that leave a fractional donor set having donor patches with unused donor material that can be used to form what is referred to herein as a fractional size image.

Conventionally, such donor material is wasted as the conventional printer simply advances the donor ribbon 30 from first donor patch set 32.1 to second donor patch set 32.2 before initiating a next job. However, in the present invention, printer controller 20 is adapted to operate in a novel mode that allows printer controller to execute a first print order using a portion of donor material from a first donor patch set 32.1 and to further use remaining portions of the donor material from the first donor patch set 32.1 to render at least a portion of a second print order.

Figure 5:
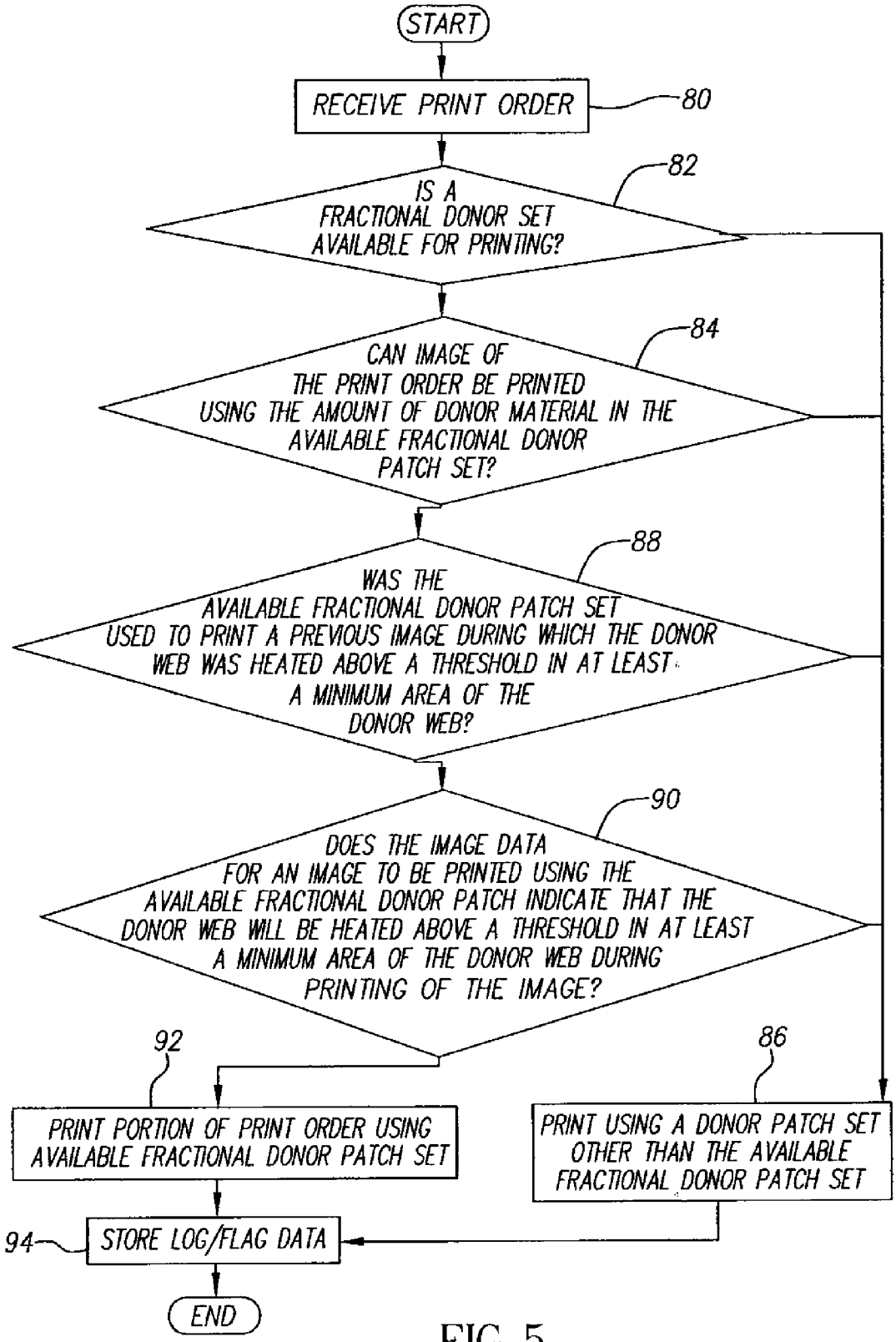
FIG. 5 shows a flow diagram of a method for operating a printer in accordance with the invention.

FIG. 5 provides a flow diagram showing one embodiment of a method for operating a printer 18 in accordance with the invention. As is shown in the embodiment of FIG. 5, a print order is received by the printer (step 80). The print order contains instructions sufficient for printer controller 20 to initiate printing operations. Printer controller 20 can receive the print order in a variety of ways including but not limited to receiving entries made by way of user input system 62, signals received at a communication system 74 or in response to a data provided by way of memory 68 including but not limited to data provided by way of a removable memory (not shown).

Each print order generally provides sufficient information from which printer controller 20 can determine what image or images are to be printed, the quantity of each images to be printed and a desired size for each printed image. Typically, the print order will provide image data for each image to be printed, however, a print order can simply designate a location at which printer controller 20 can obtain the image data.

As is shown in the embodiment of FIG. 5, printer controller 20 determines whether any fractional donor set is available on donor ribbon 30 (step 82). This can be done in a variety of ways. In one embodiment, printer controller 20 is adapted to store data that indicates whether such a fractional donor set is available. In one embodiment this is done by maintaining a log having data indicating all print orders executed using donor ribbon 30. In this embodiment printer controller 20 is adapted to analyze the log data to determine whether such a fractional donor set is available. Alternatively, printer controller 20 can be adapted to make a determination after each print job as to whether a fractional donor set is available on donor ribbon 30 and to record a fractional data flag that indicates the availability or non-availability of a fractional donor set on donor ribbon 30.

In certain embodiments of the invention, the log or flag data can be stored in memory 68 of printer 18, however, in other embodiments, the log or flag data can be stored in a memory that is physically associated with the donor ribbon 30. For example, donor ribbon 30 can be physically associated with a memory button of the type sold by Dallas Semiconductor, Dallas, Tex., USA or some other type of memory that printer controller 20 can exchange data with by way of a physical connection. The donor ribbon 30 can also be physically associated with a memory that is capable of exchanging data wirelessly with printer controller 20 for example a radio frequency identification tag can be used to store data and to provide data to printer 18 by way of an exchange of wireless signals with communication system 74.

Optionally, printer controller 20 can also determine characteristics such as the type and amount of donor material that remains in an available fractional donor patch set and can store log or flag data that indicative of such characteristics of the so that more refined determinations of the nature of the donor patch set that remains can be made. For the purposes of the discussion, it will be assumed that printer controller 20 is adapted to cause images to be printed either using an entire donor patch or to be printed in a fractional mode that uses only one half of the donor material from each donor patch. However, this is done simply for convenience, and it will be appreciated that in other embodiments of the invention, fractional sized printing can involve other fractional sizes such as quarter size, wallet size, or the like.

Printer controller 20 then determines whether at least one of the images called for in a print order can be printed using the amount of donor material that remains in the available fractional donor patch set (step 84). In this regard, printer controller 20 can optionally be adapted to determine the amount of the donor material available in the available fractional donor patch set from a log or flag or to determine the amount remaining in some other manner and then to determine whether the size of the donor medium in the fractional donor patch is sufficient to enable the use thereof for recording an image requested in the print order at the size indicated in the print order (step 84). Where there is insufficient donor material available in the available fractional donor patch set to print at least one image of the print order, printer controller 20 cause the images of the print order to be printed using donor patch sets other than the available fractional donor patch set (step 86).

However, even where sufficient donor material is available in a fractional donor patch set, it may not be desirable under all circumstances to use of such an available fractional donor patch set for printing an image. For example, during some high density printing operations, sufficient heat can be delivered to a minimum area of donor ribbon 30 to heat donor ribbon 30 in a minimum area to alter donor ribbon 30 in a manner that enables modification of donor ribbon 30 during repositioning of donor ribbon 30 if donor ribbon 30 is positioned to align unused portions of the donor patches of the fractional donor patch set with printhead 22 for printing. For example, such heating can create minor alterations to the structure of donor ribbon 30 that can enable donor ribbon 30 to be modified such as by stretching, warping, folding or tearing. It will be appreciated that such conditions are to be avoided as they can compromise the integrity of donor ribbon 30 or the ability of donor ribbon 30 to be used to render high quality images.

Accordingly, printer controller 20 is adapted to determine whether the available fractional donor patch set has been used to print a previous image during which sufficient heat was applied to donor ribbon 30 to alter the donor ribbon in a manner that can enable modification of donor ribbon 30 in the event that printer controller 20 causes donor ribbon 34 to be repositioned for printing using the available fractional donor patch set or in the event that the controller causes the available fractional donor patch set to be used to print an image (step 88).

In one embodiment of the invention, the minimum area can comprise an entire donor patch, while in other embodiments of the invention, the minimum area can comprise a substantially smaller area. The determination of the exact size of the minimum area is one that will vary based upon the type of donor ribbon used and characteristics of a printhead 22 that uses donor ribbon 30 to print images. It will be appreciated that during printing it is often the case that individual thermal elements of printhead 30 may deliver relatively high levels of heat to ensure that a desired density of donor material is applied to receiver medium 26. Where adjacent thermal elements are not heated to such relatively high levels, thermal energy from highly heated individual thermal elements can be dissipated into adjacent areas of donor ribbon 30 with little risk of altering donor ribbon 30. However, when a plurality of individual adjacent thermal elements heat donor ribbon 30 to relatively high levels, a highly heated area is formed and there is a reduced opportunity for some portions of the highly heated area to dissipate such heat and there is opportunity for alteration to donor ribbon 30. Accordingly, the term "minimum area" is used herein to indicate a portion of a donor patch that is large enough so that when the minimum area of the donor patch is heated above a threshold level there is a risk of creating an opportunity for alteration of donor medium 30.

There are a variety of ways in which such a determination can be made. In one aspect of the invention the image data representing the previously printed image or any other electronic signal used in printing the previously printed image using the available fractional donor patch set can be analyzed to identify whether such data or signal shows that a minimum portion of the donor patch was printed at a printed density that is greater than a threshold value. It will be appreciated that the printed density of an area of a donor patch is proportional to a temperature that is applied to the donor ribbon 30 accordingly, the print densities used in printing a particular area of a donor ribbon will provide a generally accurate representation of the extent to which donor ribbon 30 has been heated in that area.

The determination of the threshold value for the printed density will vary from printer to printer and/or can also vary based upon variations in the donor ribbon 30 or donor ribbons usable in such printers. Accordingly, for any given printer/donor ribbon combination, the exact threshold value can most accurately be determined through routine experimentation procedures. Because there is likely to be some variation of printing densities within all portions of an image, it can be useful to define the threshold in terms of a range of print densities or donor ribbon temperature within the minimum area, or an average, mean, or median and/or a range defined by a statistical standard deviation or the print densities within the minimum area. Conventional image processing/image analysis techniques can also be applied for the purpose of locating image data indicative of a minimum area of a donor patch that is likely to be heated above a threshold when the image is printed.

Alternatively, the heat that is that is applied to donor ribbon 30 and therefore the extent to which a minimum area of donor medium 30 can be determined based upon the amount of electrical energy applied to thermal elements including, but not limited to, thermal resistors in printhead 22 that are to generate heat during printing. In this regard printer controller 20 can determine a level of electrical energy supplied to each thermal element in printhead 22 and can determine from this an extent to which donor ribbon 30 has been heated in any given minimum area.

Where it is determined that, during the printing of a previous donor patch, donor ribbon 30 was heated in a minimum area to a level that is above a threshold (step 88), printer controller 20 can print images from the print order using donor material from a donor patch set that is other than the available fractional donor patch set (step 86). As shown in the embodiment of FIG. 1, where the amount of thermal load or heat applied to donor ribbon 30 in the printing of a previous image is below the threshold (step 88) an optional further evaluation process (step 90) is applied before using the fractional donor patch set for printing of an image from the print order.

This further evaluation process (step 90) is used where a combination of characteristics of and/or interactions between a printhead 20, take up roller 48, supply roller 50 and donor ribbon 30, and the type of image to be printed are such that there is a risk of alteration of the donor ribbon 30 that can cause undesirable modifications during the printing of the second image. Specifically, under certain combinations and with certain interaction the printing of an image that has an image density in minimum area that is above a threshold using a fractional donor patch set can create such a risk of causing an undesirable modification. Accordingly, in the embodiment of FIG. 1, an optional step is preferred wherein it is determined whether the image data for the image to be printed using the available fractional donor patch indicates that donor ribbon 30 will be heated above a threshold level within a minimum area during printing of the image represented by the image data.

Such determination can be made by analyzing the image data directly or by converting the image data into printer density data and analyzing the printer density data. Such analysis examines the image data or printer density values to identify image areas that call for printing in a manner that can heat a minimum area of a donor patch to a level above a threshold temperature level. The minimum area and threshold level used in this step can be the same minimum area and threshold levels defined above. However, this is not necessary. Further, the threshold levels can be defined in terms of averages, medians, means, statistical deviations, ranges of levels, individual levels or other statistical models of image data or printer data that are known to cause relatively high density deposition of donor material from a donor ribbon 30 and thus, have the potential for heating the donor material. Where this analysis identifies that the printing of the image will heat donor ribbon 30 above a threshold in at least a minimum area of donor ribbon 30, printer controller 20 can cause the image to be printed using a donor patch set other than the available fractional donor patch set (step 86). Optionally, where a print order contains a request for the printing of more than one image, printer controller 20 can be adapted to, repeat steps 84, 88 and 90 for each image of the print order to potentially increase the utilization of donor material from donor ribbon 30.

Where it is determined that an image of the print order can be printed using the amount of remaining donor material in an available fractional donor patch set (step 84), where it is further determined that the available fractional donor patch set has not been used to print a previous image during which the donor ribbon was heated above a threshold in at least a minimum area of the donor ribbon (step 88) and, where it is optionally determined that the image data for an image to be printed using the available donor patch set does not indicate that the donor ribbon 30 will be heated above a threshold level during printing of the image (step 90), printer controller 20 will cause the donor ribbon to be positioned so that remaining portions of the available fractional donor patch are used in printing at least one image from the print order (step 92).

Printer controller 20 can optionally store log data or flag data after printing (step 94). This log data or flag data can be used to indicate the location of an unused fractional donor patch e.g. first donor patch set 32.1 so that it can be used in a subsequent print order or alternatively, printer controller 20 can ignore that fractional donor patch set but improve donor use efficiency by using donor material from other donor patch sets (not shown). The log or flag data storing step (step 94) can also be used to prevent printing using a fractional donor patch set that has been used to print a previous image during which donor ribbon 30 was subject to heat above a threshold in at least a minimum area of one of the donor patches of the fractional donor patch sets. In one example of this type, log or flag data can simply indicate that a fractional donor patch set that has been so used is not available for printing or it can indicate that the fractional donor patch set is available but should not be used.

Figures 6, 7, 8:
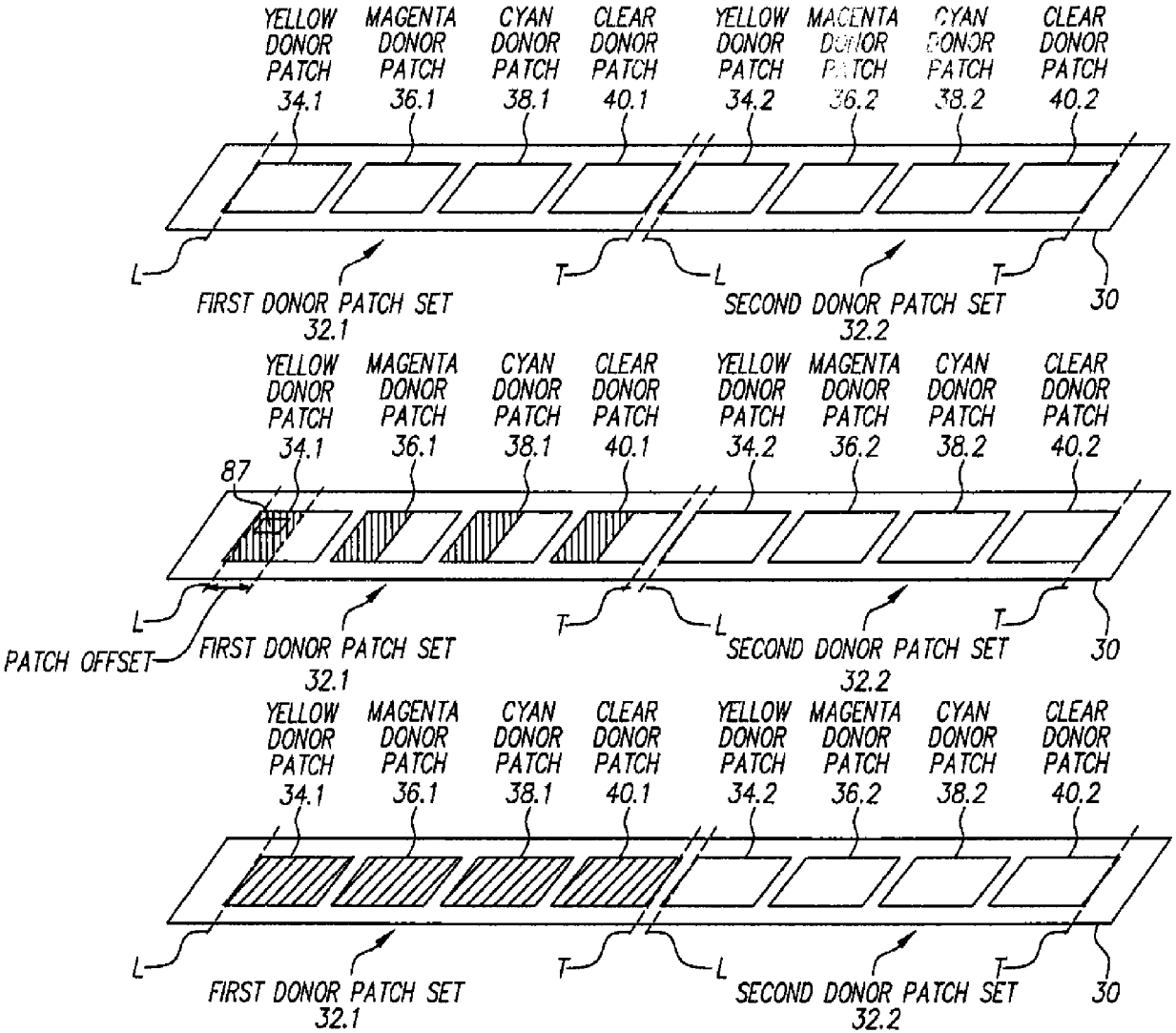
FIG. 6 illustrates a donor ribbon at the start of a first printing operation.
FIG. 7 illustrates the donor ribbon of FIG. 6 after the first printing operation.
FIG. 8 illustrates the donor ribbon of FIG. 6 after the second printing operation.

FIGS. 6-8 illustrate the application of this method to first donor patch set 32.1. As illustrated in FIG. 6, when printer 18 is at an initial start-up point, donor ribbon 30 has a first donor patch set 32.1 available for print full size printing. Printer controller 20 receives a print order for one half-sized image and causes a half sized image to be printed. As is shown in FIG. 7, at the completion of a first print order of one half-sized image first donor patch set 32.1 has donor patches 34.1, 36.1, 38.1 or 40.1 having half patches of donor material available for printing. In this embodiment, printer controller 20 stores a flag in memory 68 indicating that a fractional donor patch set is available for printing.

At the completion of the first print order, printer controller 20 can cause donor ribbon supply roller 50 and donor ribbon take up roller 48 to operate to move donor ribbon 30 from a position of donor ribbon 30 at the completion of the second print job, to a position that aligns first donor patch set 32.1 with printhead 22 for printing. In this regard, it will be appreciated that printing of a fractional sized print can be initiated immediately with printhead 22 positioned in at this location in the event that printer controller 20 determines that at least a part of a second print job can be rendered using donor material from the fraction of the donor patch set remaining in first donor patch set 32.1.

When a second print order requiring a half sized image is received, printer controller 20 can determine from the flag data that a fractional donor patch is available for printing (step 90). Printer controller 20 then determines whether the half-sized image can be printed using the amount of donor material available in fractional donor patch set 32.1 (step 84). Where this is possible and where the available fractional donor patch set has not been used to print a previous image during which the donor ribbon was heated above a threshold in at least a minimum area (step 88) and, optionally where the image data for the second image to be printed does not indicate that the donor ribbon 30 will be heated above a threshold level during printing of the image (step 90), printer controller 20 can direct the second image for printing using donor material from the available fractional donor patch set 32.1 to be printed (step 92).

One example of a minimum area that is smaller than a donor patch is illustrated in FIG. 7. This example is provided for illustration purposes only and is not limiting.

Where it is not possible to use the fraction of the first donor patch set 32.1 that remains to print an image from a print order (step 84), printer controller 20 can cause donor media to be advanced so that a leading edge of the first donor patch in the second donor patch set 32.2 can be used for printing the image or images called for in the print order (step 86).

It will be appreciated that, in order to use donor material from the fractional donor patch set 32.1 in rendering a portion of a second print order, printer controller 20 must be capable of properly positioning donor patch set 32.1 so that printhead 22 confronts only portions of the donor patches 34.1, 36.1, 38.1 and 40.1 that were not used during satisfaction of the first print order. This requires that printer controller 20 determine which portions of each donor patch remain unused after the first print order and that printer controller is also capable of properly and accurately positioning the donor material relative to printhead 22 for printing such sections.

Printer controller 20 determines whether unused portions of the donor patches 34.1, 36.1, 38.1, 40.1, are available for use in printing by analysis of log data, or flag data as described generally above. Printer controller 20 can use this flag data to designate that each of donor patches 34.1, 36.1, 38.1 and 40.1, have half patches of donor material remaining.

Printer controller 20 can controllably position donor ribbon 30 so that portions of a first donor patch set 32.1 can be used in rendering at least a part of a second print order by causing donor ribbon take-up roller 48 and donor ribbon supply roller 50 to reverse the direction of donor ribbon movement after completing the first printing job and by using position sensor 70 to detect the start of first donor patch set 32.1 in the same manner as position sensor 70 can detect the start of first donor patch set 32.1 when donor ribbon 30 is advanced in a forward direction.

Once a donor ribbon 30 is positioned at the start of fractionally used first donor patch set 32.1, printer controller 20 can determine a usable patch offset distance from the leading edge of each patch and can use the offset distance to adjust the pattern of donor ribbon movement so that only unused fractions of each donor patch are used for printing. Printer controller 20 determines the useable patch offset distance based upon the size of the fractional image printed using the first donor patch and the overall size of the donor patch. For example, where donor patches 34.1, 36.1, 38.1 and 40.1 of first donor patch set 32.1 shown in FIG. 6 are each 6"×8" patches and where the first print order required a first print that was of 6"×4" size, it can be determined that the first print order consumed the first four inches of each donor patch. Accordingly, printer controller 20 determines patch offset distance of 4 inches as is illustrated in FIG. 7. When a subsequent print order is received that requires the printing of a 6"×4" image, printer controller causes donor ribbon 30 to be moved forward four inches from the start the first donor patch in first donor patch set 32.1, yellow donor patch 34.1, and requires that printing begin at that point and continue only for another four inches. Printer controller 20 then moves donor ribbon 30 a distance that is equivalent to a full donor patch plus any inter-patch spacing so that printing of the second donor patch begins four inches from the start of the next donor patch, magenta donor patch 36.1. This process repeats for each donor patch, exhausting all of the donor patches 34.1, 36.1, 38.1, and 40.1 of first donor patch set 32.1.

In this way, portions of first donor patch set 32.1 that were not used in rendering a first print order can be used to render at least a part of a second print order.

It will be appreciated that using this approach, a printer controller 20 is provided that is adapted to direct printing orders to thermal printers so that the number of thermal printers that have fractional donor media available for printing at the start of a subsequent printing job is minimized.

The invention has been described in detail with particular reference to certain preferred embodiments thereof, but it will be understood that variations and modifications can be effected within the spirit and scope of the invention.

PARTS LIST

18 printer
20 printer controller
22 printhead
26 receiver medium
30 donor ribbon
32.1 first donor patch set
32.2 second donor patch set
34.1 yellow donor patch
34.2 yellow donor patch
36.1 magenta donor patch
36.2 magenta donor patch
38.1 cyan donor patch
38.2 cyan donor patch
40.1 clear overcoat patch
40.2 clear overcoat patch
42 receiver medium take-up roller
44 receiver medium supply roller
46 platen roller
48 donor ribbon take-up roller
50 donor ribbon supply roller
52 image receiving area
54 stripping plate
56 idler roller
62 user input system
64 output system
66 sensors
68 memory
70 position sensor
71 removable memory interface
72 hard drive
74 communication system
75 movement sensor
76 remote memory
77 follower wheel
79 receiver medium position sensor
80 receive print order step
82 determine available fractional sized print step
84 can a portion of the print order be satisfied using the fractional donor patch set
86 print using donor patch set other than available fractional donor patch set
87 minimum area
88 available fractional donor patch set used to print a previous image during which the donor ribbon was subject to heat above a threshold in at least a minimum area of the donor use next donor patch set determining step
90 image data for an image to be printed using the available fractional donor patch indicate that the donor ribbon will be heated above a threshold in at least a minimum area of the donor ribbon during printing of the image determining step
92 print using available fractional donor patch set
94 store location of fractional donor patch set

The invention claimed is:

1. A method for operating a thermal printer adapted to print an image by heating donor material from one of sequence of sets of donor material patches on a donor ribbon and transferring the heat donor material to a donor ribbon, the method comprising the steps of:

receiving image data for a first image to be printed;

printing the first image exhausting only a fraction of a full donor patch set to leave a fractional donor patch set having sufficient donor material for the printing of a second image; and preventing the printing of a second image using the fractional donor patch set when it is determined that the printing of the first image has heated a minimum area of one of the donor patches of the donor ribbon above a threshold level.

2. The method of claim 1, further comprising the steps of receiving image data for the second image to be printed and preventing printing of the second image using the fractional donor patch set when analysis of image data for the second image indicates that the donor ribbon will be heated above a threshold level in a minimum area of at least one of the donor patches of the donor ribbon.

3. The method of claim 2, further comprising the step of storing data indicating when a donor patch set comprises a fractional donor patch set having sufficient donor material available for printing a second image and wherein the step of preventing printing using a fractional donor patch set comprises storing data indicating that a fractional donor patch set is not available for printing wherein the second image is not printed using a fractional donor patch set unless the stored data indicates that the fractional donor patch set is available for printing.

4. The method of claim 1, wherein the step of preventing printing using the fractional donor patch set comprises advancing the donor ribbon to a subsequent full donor patch set and inhibiting reversing the position of the donor ribbon.

5. A control system for a thermal printer adapted to print images by transferring donor material from patches of donor material on a donor ribbon to form an image on a receiver medium, said printer being operable to print images in a manner that exhausts a full donor patch set or in a manner that exhausts a fractional donor patch set during printing, the control system comprising:

a controller adapted to receive a print order, to determine whether a fractional donor patch set is available for printing; and to cause an image to be printed using donor material from an available fractional donor patch set where at least part of the print order can be satisfied using donor material from the fractional donor patch set except where said controller determines that the available fractional donor patch set has been used to print a previous image having an average image density in a minimum portion of the image that is greater than a threshold average image density.

6. The control system of claim 5, wherein the controller is further adapted so that it will not print using the available fractional donor patch set when the controller determines that the image data for the image to be printed calls for the printing of an image having an average density in a minimum area that is greater than a threshold average density.

7. The control system of claim 6, wherein the controller is adapted to store data in a memory indicating that a donor patch set on the donor ribbon comprises a fractional donor patch set that is available for printing only after printing in a manner that exhausts a fractional donor patch set and only when no portion of the fractional donor patch set has been used to print an image having a minimum area with an average image density greater than the threshold average image density.

8. The control system of claim 7, wherein said memory that is physically associated with the donor medium, and further comprising a communication system that is adapted to exchange data with the memory.

9. The control system of claim 7, wherein said memory comprises a radio frequency transponder having a memory for storing data and further comprising a radio frequency transceiver that is adapted to exchange data with the memory in the radio frequency transponder using radio frequency signals.

10. The control system of claim 7, wherein controller examines the image density of the previously printed image by examining the density of each color used to print the image.

11. A control system for operating a thermal printer adapted to print images by heating and transferring donor material from donor patch sets from onto a receiver medium, the printer being operable to print images in a manner that exhausts a full donor patch set or a fractional donor patch set during printing, comprising:

a means for receiving a print order; and a controller for determining whether a fractional donor patch set is available that has not been used to print a previous image during which sufficient heat was applied to the donor ribbon to alter the donor ribbon in a manner that can enable modification of the donor ribbon in the event that the controller causes the donor ribbon to be repositioned for printing using the fractional donor patch set or in the event that the controller causes the fractional donor patch set to be used to print an image from the print order;

wherein said controller further determines when an image from the print order can be printed using an available fractional donor patch set and causes the image from the print order to be printed using the available fractional donor patch set.

12. The control system of claim 11, wherein said controller will not use an available donor patch set for printing an image when the image to be printed requires the application of heat to a minimum area of one of the donor patch sets that alters the donor ribbon in a manner that can enable modification of the donor ribbon while printing using the fractional donor patch set.

13. The control system of claim 11, wherein said controller is adapted to select an image from the print order for printing using the fractional donor patch set from among other images in the print order by analyzing the images of the print order and selecting an image that can be printed without requiring the application of sufficient heat to a minimum area of one of the donor patch sets to alter the donor ribbon in a manner that can enable modification of the donor ribbon while printing using the fractional donor patch set.

14. A control system for operating a thermal printer adapted to print images by heating and transferring donor material from donor patch sets from onto a receiver medium, the printer being operable to print images in a manner that exhausts a full donor patch set or a fractional donor patch set during printing, comprising:

a controller for identifying one of the donor patch sets on the web as a fractional donor patch set having sufficient donor material remaining to print an image, said controller further being adapted to determine that the fractional donor patch set is not to be used for printing when the identified fractional donor patch set has been used to print an image wherein at least a minimum area of at least one donor patch has been heated to a level above a threshold level.

15. The control system of claim 14, wherein said controller is further adapted to receive image data for an image that can be printed using the identified fractional donor patch set and to use the identified fractional donor patch set to print the image only where it is further determined that the printing of the image represented by the image data does not require heating the donor material of at least one donor patch above a threshold level.

16. The control system of claim 14, wherein the controller is adapted to determine that a minimum area of at least one donor patch of a fractional donor patch set has been heated to a level above a threshold level by analyzing image data, printer density values or other electrical signals used when the fractional donor patch set was used to print a previous image.

* * * * *